US005101989A

United States Patent [19]

Jones

[11] Patent Number: 5,101,989

[45] Date of Patent: Apr. 7, 1992

[54] DISPLAY SYSTEM

[75] Inventor: Stephen R. Jones, Alfords Point, Australia

[73] Assignee: Rollup Industries Pty Ltd., Australia

[21] Appl. No.: 509,678

[22] Filed: Apr. 16, 1990

[51] Int. Cl.[5] ..... A47H 1/00

[52] U.S. Cl. ..... 211/94; 248/220.3

[58] Field of Search ..... 211/94, 59.1, 87, 189; 248/220.3; 52/36, 38, 588

[56] References Cited

U.S. PATENT DOCUMENTS

| | | | |
|---|---|---|---|
| 4,098,481 | 7/1978 | Johnson et al. | 211/90 X |
| 4,450,970 | 5/1984 | Shepherd | 211/90 X |
| 4,615,448 | 10/1986 | Johnstonbaugh | 211/94 |
| 4,678,151 | 7/1987 | Radek | 211/94 X |
| 4,825,601 | 5/1989 | Halverson | 211/94 X |
| 4,944,416 | 7/1990 | Petersen et al. | 211/94 X |

*Primary Examiner*—J. Franklin Foss
*Attorney, Agent, or Firm*—Townsend and Townsend

[57] ABSTRACT

A modular merchandise wall display system having decorative slats is provided that may be easily changed without dismantling a display arrangement of hooks or shelves. The decorative slats are supported by guide members which are inserted into longitudinal channels provided in the backing plate of the wall display system. The weight of the displayed goods is transferred from the display brackets through the guide members and channels to the wall supporting frame. The backing plate can be fabricated at low cost and of relatively light weight material because the weight of the goods is transferred to the load bearing wall studs or supports rather than to the backing plate. A variety of display brackets is provided such that the weight of the display goods can be supported by either one or two guide members.

12 Claims, 2 Drawing Sheets

DISPLAY SYSTEM

The present invention relates to display walls for shops and like commercial enterprises in which goods to be sold are displayed by means of hooks and the like.

It is known from Australian Patent Specification No. 559,802 (58077/86) to provide a wooden panel with routed grooves of T-shaped cross-sectional configuration into which are slid extruded C-shaped guides in order to strengthen the slot. Brackets for clothes and the like are supported by engagement with the interior of the slots or guides.

This known arrangement suffers from two disadvantages. The first is that the wooden material of the panel is relatively expensive, heavy to transport and liable to be damaged during transportation or erection. Secondly, the panel is normally laminated so that only a single background colour is available for the display wall.

It is the object of the present invention to provide an improved display wall system in which a relatively light weight and low cost backing panel is provided, and provision is made for a number of decorative slats to be mounted in front of the backing panel so that multi-coloured decorative schemes can be selected, if desired, by the shop proprietor.

According to one aspect of the present invention there is disclosed a display system for shops and like commercial enterprises, said system comprising a backing plate adapted to be directly mounted to a wall supporting frame, said plate having a plurality of channels formed therein and extending across said plate, a plurality of guide members each of which is received in a corresponding one of said channels, and a plurality of decorative slats each of which is retained between a pair of adjacent guide members. Preferably the guide members also support mounting brackets for articles to be displayed for sale.

Figures 1, 1A:
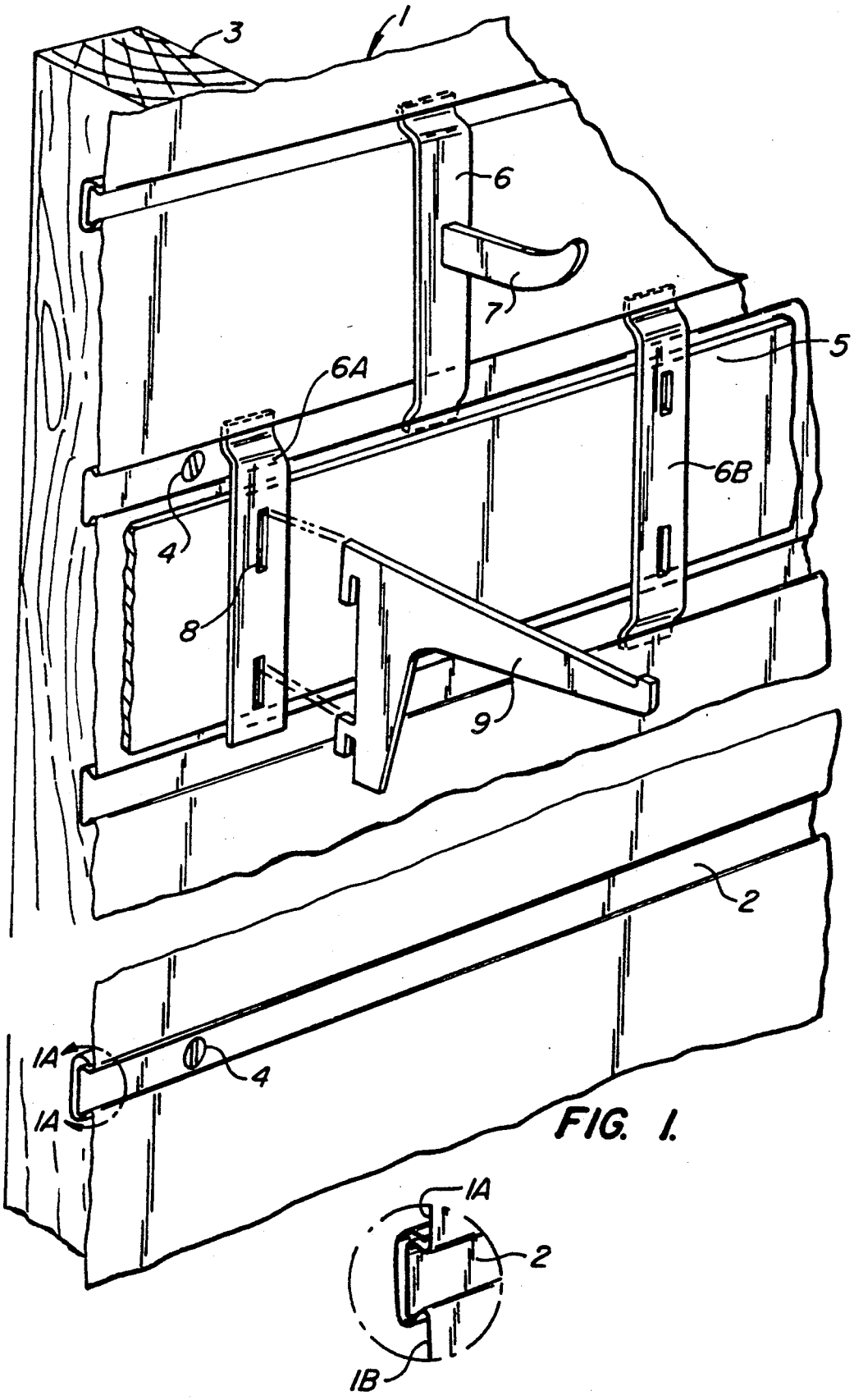
Figure 2:
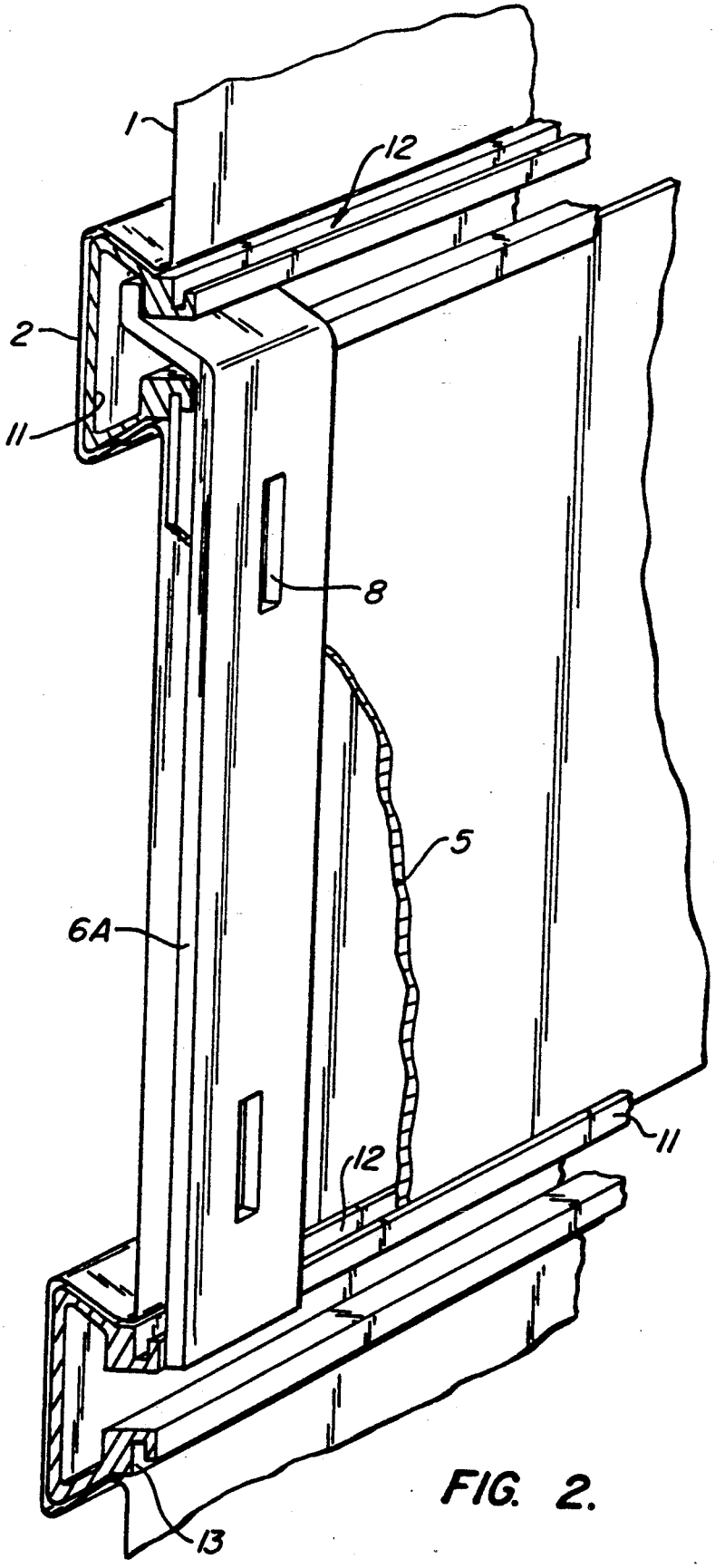

An embodiment of the present invention will now be described with reference to the drawings in which:

FIG. 1 is an exploded perspective view of the display wall of the preferred embodiment during its erection, a portion of one channel being illustrated to an enlarged scale, FIG. 1A shows an enlarged portion of FIG. 1, and FIG. 2 is a view similar to FIG. 1 but illustrating the portion of the finished wall between adjacent channels.

As seen in FIG. 1, the display wall of the preferred embodiment comprises a backing plate 1 preferably rolled from galvanized sheet steel so as to provide a plurality of parallel, equispaced, channels 2 of generally T-shaped configuration. As indicated in FIG. 1 the backing 1 can be directly secured to a stud 3 or like wall supporting member by means of fasteners 4. Preferably, the fasteners 4 can be located within the channels 2.

As seen in the enlarged portion of FIG. 1, as the width of each individual backing plate 1 is normally less than the height of the given wall, adjacent plates 1 are joined by interconnecting two partially formed channels. In this way a strong joining arrangement is achieved without any disruption to the regular spacing between the channels 2.

As indicated generally in FIG. 1, in front of the backing plate 1 decorative slats 5 are provided, provision being made for a decorative slat 5 to be located between each pair of adjacent channels 2. In addition, the channels 2 (indirectly) support brackets 6, 6A and 6B carrying hook 7 or slots 8 engageable with cantilever shelf support 9 in known fashion.

FIG. 2 illustrates the detail of the interengagement of the slats 5, channels 2 and brackets 6A. As seen in FIG. 2, an extruded guide 11 having an external configuration which corresponds substantially identically with that of the interior shape of the channels 2, is provided. Each guide 11 is hollow and is slidingly retained within a corresponding one of the channels 2. Furthermore, each guide 11 has an upwardly and downwardly directed groove 12 and 13 respectively, the inner surface of each groove 12, 13 being substantially flush with the outwardly facing surface of the backing plate 1. The guides 11 can be manufactured from materials such as aluminium, steel, rigid plastics material or lightweight alloys.

As indicated in FIG. 2, each decorative slat 5 is able to be slid between each adjacent pair of guides 11, the slat 5 being retained in the grooves 12, 13. The thickness of the slat 5 corresponds to the width of the grooves 12, 13.

In this way, the backing plate 1 is substantially hidden from view and the light weight, inexpensive slats 5 can be fabricated from plastics material in a wide range of colours and shades.

Furthermore, as illustrated in FIG. 2 a slotted bracket 6A is provided, the upper end of the bracket 6A being hooked to enable the bracket 6A to be engaged with, and disengaged from, the interior of the guides 11 without having to be slid along the guide. In addition, the length of the bracket 6A is arranged to be such that the lower end of the bracket 6 just reaches, and is supported by, the guide 11 retained in the next adjacent, lower channel 2. In this way, the weight of a shelf, for example transmitted via shelf supports 9 (FIG. 1) to the bracket 6A, is transferred to the guide 11 and hence to the studs 3 without providing any significant load upon the thin sections of the backing plate 1 between the channels 2 which have little resistance to bending.

An alternative form of bracket 6A, bracket 6B, is also illustrated in FIG. 1, this bracket being hooked at both its upper and lower ends so as to be slidingly retained between an adjacent pair of guides.

It will be apparent that the abovedescribed arrangement has a number of substantial advantages. Firstly, the backing plates 1 can be fabricated at low cost and are relatively light in weight. Furthermore, if inadvertently damaged during transit or erection, the backing plate 1 can often be bent or hammered back into the correct shape. In addition, the slats 5 can be provided in a wide range of colours and therefore a wide variety of decorative appearances can be achieved. In addition, the slats 5 can be easily changed between merchandising campaigns so as to entirely change the appearance of a wall.

The brackets 6, 6A and 6B enable merchandise to be directly supported by means of hooks from the wall, or displayed on shelves which are in turn supported by the wall. The guides 11 enable the forces generated by such shelving or displayed articles to be transmitted directly to the load bearing studs 3.

The foregoing describes only one embodiment of the present invention and modifications, obvious to those skilled in the art, can be made thereto without departing from the scope of the present invention.

What I claim is:

1. A display system for shops and like commercial enterprises, said system comprising a backing plate having this sections and adapted to be directly mounted to a wall supporting frame, said plate having a plurality of channels formed therein; said channels extending across said plate and having an interior, a plurality of guide members each of which is received in said interior of a corresponding one of said channels, said guide members having an upper extension and a lower extension protruding from said interior defining a longitudinally extending opening leading to a hollow guide member interior, said upper and lower extensions each having a horizontally extending substantially vertical groove on an upper and lower surface, respectively, bracket means for supporting display goods and a plurality of decorative slats each of which is retained between an upper and lower groove of a pair of adjacent guide members.

2. A display system as claimed in claim 1, wherein said backing plate has top and bottom edges which are substantially parallel to said channels, said edges being formed respectively as first and second partially formed complementary channels whereby a plurality of said backing plates can be interconnected by locating one partially formed channel of one backing plate inside the other partially formed channel of another backing plate.

3. A display system as claimed in claim 1, wherein said guide members have an external configuration that is substantially complementary with the interior shape of said channels, each said guide member being slidingly retained within a corresponding one of said channels.

4. A display system as claimed in claim 1, wherein said guide members are extruded from materials selected from the group consisting of: aluminium, steel, rigid plastics and lightweight alloys.

5. A display system as claimed in claim 1, wherein said supporting bracket means comprise a plurality of brackets acting as supports for displayed goods, each of said brackets supported by a pair of said guide members, at least one end of each bracket being retained in said guide member interior.

6. A display system as claimed in claim 5 wherein each said bracket has one (upper) end adapted to be received within the upper guide member of an adjacent pair of guide members, and each said bracket has a second adapted to abut against the lower guide member of said adjacent pair of guide members.

7. A display system as claimed in claim 5 wherein each said bracket has its first and second end adapted to be received within the corresponding one of a pair of adjacent guide members.

8. A display system as claimed in claim 6, wherein said brackets have formed thereon hooks arranged to directly support said goods.

9. A display system as claimed in claim 6, wherein said brackets have formed therein slots engageable with cantilever shelf supports.

10. A display system as claimed in claim 7, wherein said brackets have formed thereon hooks arranged to directly support said goods.

11. A display system as claimed in claim 7, wherein said brackets have formed therein slots engageable with cantilever shelf brackets.

12. A display system as claimed in claim 1 wherein said backing plate is rolled from galvanised sheet steel.

* * * * *